United States Patent [19]

Diesch et al.

[11] 4,147,080

[45] Apr. 3, 1979

[54] MULTICHANNEL INDICIA SENSOR FOR AUTOMATIC PHOTOGRAPHIC PAPER CUTTER

[75] Inventors: Robert E. Diesch, Rogers; Gerald R. Strunc, Maple Grove, both of Minn.

[73] Assignee: Pako Corporation, Minneapolis, Minn.

[21] Appl. No.: 837,986

[22] Filed: Sep. 29, 1977

[51] Int. Cl.[2] ..... B26D 5/38

[52] U.S. Cl. ..... 83/371; 83/210; 83/365

[58] Field of Search ..... 83/371, 365, 362, 208, 83/210, 211

[56] References Cited

U.S. PATENT DOCUMENTS

| | | | |
|---|---|---|---|
| 3,143,017 | 8/1964 | Donnell | 83/365 |
| 3,699,832 | 10/1972 | Smith et al. | 83/210 |
| 3,763,728 | 10/1973 | Blackman | 83/210 |
| 3,793,915 | 2/1974 | Hujer | 83/371 |

*Primary Examiner*—Donald R. Schran

*Attorney, Agent, or Firm*—Kinney, Lange, Westman and Fairbairn

[57] ABSTRACT

An automatic photographic paper cutter cuts photographic prints from a roll of photographic paper which bears indicia indicating the location of desired cuts. The automatic photographic paper cutter has an improved indicia sensing system which includes a plurality of indicia sensors, each positioned to sense indicia on a different portion of the photographic paper. Prior to automatic operation of the paper cutter, an indicia bearing portion of the photographic paper is oscillated back and forth past the plurality of the indicia sensors. One of the sensors which provides an acceptable output signal is selected, and subsequent operation of the photographic paper cutter is controlled in response to signals from the selected sensor.

18 Claims, 7 Drawing Figures

MULTICHANNEL INDICIA SENSOR FOR AUTOMATIC PHOTOGRAPHIC PAPER CUTTER

REFERENCE TO CO-PENDING APPLICATIONS

Reference is made to the following co-pending patent applications which are filed on even date with this application and are assigned to the same assignee as this application: Ser. No. 838,064 "Microprocessor Controlled Photographic Paper Cutter" by G. Strunc and F. Laciak; Ser. No. 837,987 "Paper Drive Mechanism for Automatic Photographic Paper Cutter" by R. Diesch; Ser. No. 837,988 "Stepper Motor Control" by G. Strunc; Ser. No. 838,165 "Print and Order Totalizer for Automatic Photographic Paper Cutter" by G. Strunc; Ser. No. 838,000 "Paper Feed Control for Automatic Photographic Paper Cutter" by R. Diesch and G. Strunc; Ser. No. 837,999 "Photographic Paper Cutter with Automatic Paper Feed in the Event of Occasional Missing Cut Marks" by G. Strunc and Ser. No. 837,998 "Knife Assembly for Photographic Strip Cutter" by R. Diesch. Subject matter disclosed but not claimed in the present application is disclosed and claimed in these co-pending applications.

BACKGROUND OF THE INVENTION

The present invention relates to photographic processing equipment. In particular, the present invention relates to an improved indicia sensor system for use in an automatic photographic paper cutter.

In commercial photographic processing operations, very high rates of processing must be achieved and maintained in order to operate profitably. To expedite the photographic processing, orders containing film of similar type and size are spliced together for developing. As many as 500 to 1000 rolls of 12, 20 and 36 exposure film may be spliced together for processing and printing purposes.

After developing, the photographic images contained in the film negatives are printed in an edge-to-edge relationship on a continuous strip of photosensitive paper by a photographic printer. The photographic printer causes high intensity light to be passed through a negative and imaged on the photographic print paper. The photographic emulsion layer on the print paper is exposed and is subsequently processed to produce a print of the image contained in the negative.

After the strip of print paper has been photoprocessed to produce prints, a photographic paper cutter cuts individual prints from the strip. The prints are then sorted by customer order and ultimately packaged and sent to the customer.

Automatic print cutters have been developed which automatically cut the print paper into individual prints. These automatic print cutters are controlled by indicia which are placed along the print paper by the photographic printer. Typically the indicia are of two types: cut marks and end-of-order marks. The cut marks indicate the desired location of a cut between adjacent prints. The end-of-order marks, which typically appear along the opposite edge of the print paper from the cut marks, indicate the end of a customer's order. The automatic paper cutter includes a sensor which senses the cut mark and causes the individual prints to be cut from the strip at the desired locations. The separated prints are passed to an order packaging or grouping device, which groups the prints in response to the end-of-order marks which are sensed by the automatic cutter.

Unfortunately, the cut marks and the end-of-order marks produced by photographic printers are not standardized as to shape, size, or location with respect to the edge of the print paper. As a result of this variation in indicia size, shape, and location, the indicia sensors utilized in previous automatic cutters have required highly critical adjustment of the position of the sensor by the operator. This is very undesirable since the adjustments are time consuming and are highly dependent upon the skill of the operator.

In a co-pending patent application by R. Harvey, G. Strunc, and D. Putzke entitled "Wide Scanning Angle Sensor" now U.S. Pat. No. 4,084,099, which is assigned to the same assignee as the present application, an improved, wide scanning angle indicia sensor is described. The wide scanning angle sensor has a wider angle sensing capability that the sensors which have been used in previous automatic paper cutters. It accommodates, therefore, greater variation in indicia size, shape, and location than the prior art indicia sensors.

While the wide scanning angle sensor described in U.S. Pat. No. 4,084,099 offers significant advantages over the prior art sensors, further improvements in indicia sensing are desirable. For example, the wide scanning angle sensor still requires adjustments in the position of the sensor by the operator. In addition, an indicia sensor system capable of accomodating even greater variation in indicia size, shape, and location is desirable.

SUMMARY OF THE INVENTION

The present invention is an improved indicia sensor system for use in a photographic paper cutter. This system accommodates wide variations in indicia size, shape, and location on the paper without requiring adjustment of the position of the sensor by the operator.

The improved indicia sensor system of the present invention includes a plurality of indicia sensors, each positioned to sense indicia on a different portion of the photographic paper. Prior to normal operation of the paper cutter, paper feed oscillating means feeds an indicia bearing portion of the photographic paper back and forth past the plurality of indicia sensors. Select means selects one of the plurality of indicia sensors which provides an acceptable output signal when the indicia bearing portion of the photographic paper is fed back and forth past the plurality of indicia sensors. During normal operation of the paper cutter, control means control the operation of the cutter in response to output signals from the indicia sensor selected by the select means.

BRIEF DESCRIPTION OF THE DRAWINGS

FIG. 1 is a perspective view of an automatic paper cutter utilizing the multichannel indicia sensor of the present invention.

FIG. 3 is an electrical block diagram of the automatic paper cutter of FIG. 1.

DESCRIPTION OF THE PREFERRED EMBODIMENTS

Introduction

Figure 7:
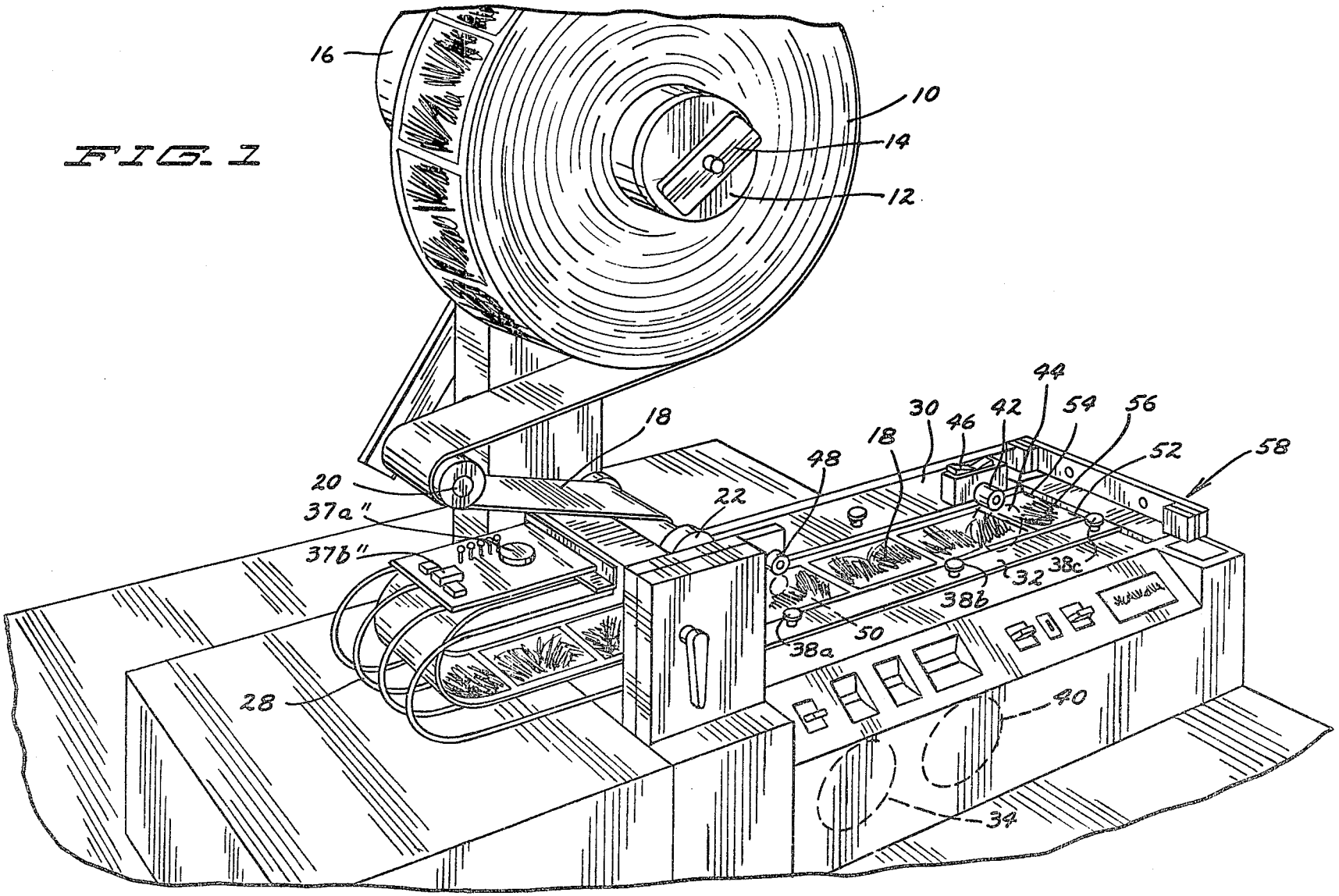
FIGS. 6 and 7 are electrical schematic diagrams of a portion of the auxiliary control panel and the sensor amplifier circuit related to the multichannel indicia sensor of the present invention.

The multichannel indicia sensor of the present invention may be used in conjunction with the previously available automatic photographic paper cutters. It has been used to particular advantage, however, in a high speed, microprocessor controlled, automatic paper cutter. For that reason, the multichannel indicia sensor of the present invention will be described in the context of the high speed, microprocessor controlled, automatic paper cutter.

The following section, which is entitled "System Overview", generally describes the operation of the high speed, microprocessor controlled, photographic paper cutter. A more detailed description of the electrical control system of the automatic paper cutter may be found in the previously mentioned co-pending patent application Ser. No. 838,064 entitled "Microprocessor Controlled Photographic Paper Cutter" by G. Strunc and F. Laciak, and a more detailed description of the paper supply and drive mechanism may be found in the previously mentioned patent application Ser. No. 837,987 entitled "Paper Drive Mechanism for Automatic Photographic Paper Cutter" by R. Diesch. The other co-pending patent applications referred to in the "Reference to Co-Pending Applications" also describe various aspects of the automatic photographic paper cutter shown in the Figures.

A detailed description of the multichannel indicia sensor of the present invention is contained in the section entitled "Multichannel Indicia Sensor" which follows the section entitled "System Overview". Detailed mechanical and electrical drawings illustrate a preferred embodiment of the multichannel indicia sensor of the present invention.

System Overview

FIG. 1 is a perspective view of the high speed, microprocessor controlled, automatic paper cutter which includes the multichannel indicia sensor of the present invention. The paper cutter includes five major portions: a paper supply, a paper drive mechanism, a knife assembly, main and auxiliary control panels, and control electronics.

The paper supply is an integral part of the paper cutter. A paper roll 10 is loaded from the front on to hub 12, and a lever 14 is tightened to hold paper roll 10 in place. By tightening lever 14, an elastomer material is expanded to give a press fit on the inside diameter of the core of paper roll 10. The rotation of hub 12 is controlled by electro-mechanical brake 16.

Paper strip 18 from roll 10 is trained over bale arm assembly 20 and guide roller 22, between drive and idler pinch rollers (not shown) into wire form retainer 28, and then to paper guides 30 and 32 of the paper drive mechanism. The drive pinch roller is driven by the same AC motor 34 which drives the knife assembly of the paper cutter. The motor 34 drive is transmitted to the drive pinch roller through a belt drive and electromechanical clutch 36 (shown schematically in FIG. 3).

The paper supply assembly supplies paper strip 18 with essentially no drag to the paper drive mechanism. This is important since the paper cutter operates at extremely high speeds. A detailed description of the operation of the paper supply and paper drive mechanism shown in FIG. 1 may be found in the previously mentioned co-pending application Ser. No. 837,987 by R. Diesch entitled "Paper Drive Mechanism for Automatic Photographic Paper Cutter".

The paper drive mechanism includes paper guides 30 and 32, which receive paper strip 18 from the paper supply assembly. Rear guide 30 is fixed and front guide 32 is movable so that various paper widths can be accommodated. Front paper guide 32 is adjusted by loosening thumbscrews 38*a*, 38*b* and 38*c*, and moving front guide 32 to the desired position.

Paper strip 18 is driven by stepper motor 40 through idler and drive pinch rollers 42 and 44. Idler roller 42 has a lever 46 to locate idler roller 42 in the engaged position for operation and in the disengaged position for loading paper, shipping, and other non-operating modes. Rollers 42 and 44 are located at the rear edge of strip 18 so the entire print is visible to the operator. Additional guidance of paper strip 18 is provided by another set of idler rollers 48 and 50, which are located near the end of the paper cutter.

Front and rear indicia sensor assemblies 52 and 54 are mounted below top plate 56 and sense all types of marks which appear on the back side of paper strip 18. Both front and rear sensors 52 and 54 are at a fixed distance from the knife assembly. Front sensor 52 is attached to front paper guide 32 so that movement of front guide 32 in the direction perpendicular to paper travel results in a corresponding movement of front sensor 52. Rear sensor 54, like rear paper guide 32 is not movable.

The arrangement of the sensors shown in FIG. 1 eliminates any need for operator adjustment of the position of the sensors. No operator adjustment of position in the direction perpendicular to paper motion is required because front and rear sensors 52 and 54 are multichannel sensors having, in one preferred embodiment, four individual sensor segments which may be selected by the operator by means of sensor select switches. One of the four individual sensor segments will provide an acceptable output signal in response to cut indicia (or marks) or end-of-order indicia (or marks). Controls on the control panel assembly allow the operator to determine the particular sensor segment providing an acceptable signal and to select that sensor segment.

It can also be seen from FIG. 1 that front and rear sensors 52 and 54 have been positioned as close as possible to the knife assembly. Front and rear sensors 52 and 54 are positioned at a fixed distance from the knife assembly which is less than the length of the shortest print to be cut from the paper strip 18. This arrangement eliminates the difficult positioning of the sensors along the path of paper travel. Further description of this aspect of the automatic paper cutter may be found in the previously mentioned co-pending patent application Ser. No. 838,000 entitled "Paper Feed Control for Automatic Photographic Paper Cutter" by R. Diesch and G. Strunc.

The knife assembly 58 includes a base, a spring-wrap clutch mechanism 60 (shown schematically in FIG. 3), AC motor 34 (which also drives the drive pinch roller of the paper supply), a main drive shaft, two crank arm assemblies, two vertical drive shafts, and interchangeable blades. One blade is used for cutting straight-bordered and straight-borderless prints, and another blade is used for cutting round-cornered borderless prints.

Figure 2:
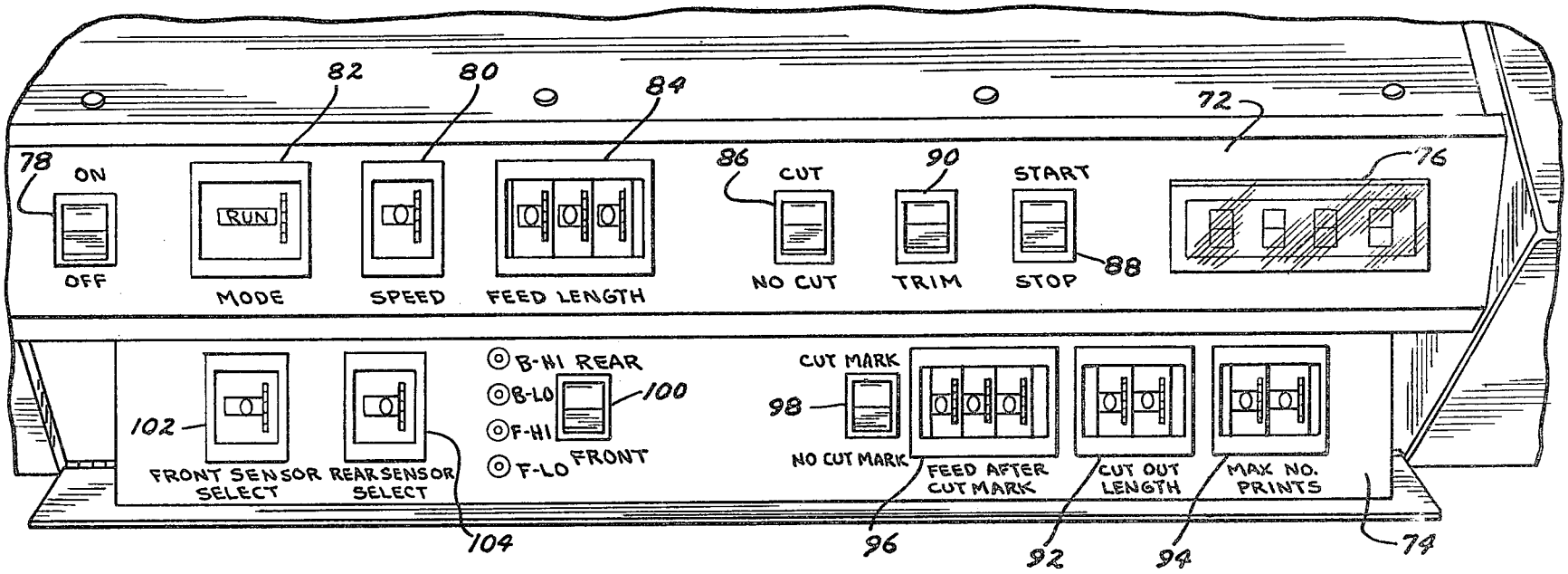
FIG. 2 shows the main and auxiliary control panels of the automatic paper cutter of FIG. 1.
Figure 9:
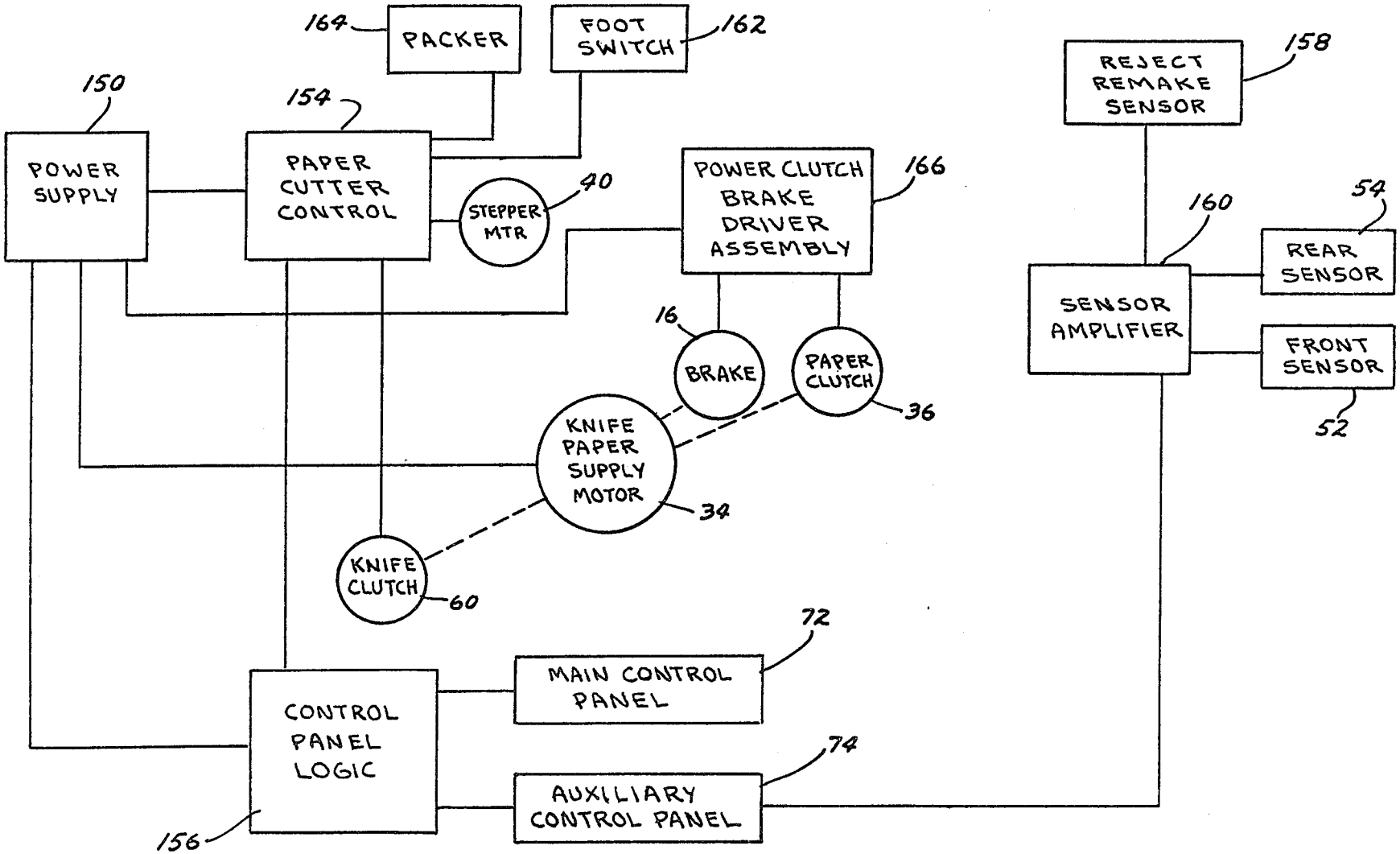

FIG. 2 shows the main and auxiliary control panels 72 and 74. Main control panel 72, which is located at the front of the paper cutter, has a display 76 and seven switches. These seven switches are Power switch 78, Speed Select switch 80, Mode Select switch 82, Feed Length switch 84, Cut/No Cut switch 86, Start/Stop switch 88, and Trim switch 90.

Display 76 is a four-digit LED seven-segment display. It can be used for a number of functions, such as print count per order, feed length setup, feed-after-sense setup, length of cut-out, and prints cut per shift or per day. The print count per order is held until the next order has been completed. When the automatic paper cutter is used in conjunction with a photopacker, the print count is incremented on display 76 after each cut.

Power switch 78 is a two-position toggle switch. This switch turns on power to the automatic paper cutter.

Speed Select Switch 80 is a one-digit, ten-position digital thumbwheel switch. Ten discrete paper cutter cycle speeds can be selected. The speeds vary from 800 to 4200 steps per second in nine increments, with each increment being 20% larger than the previous speed.

Mode switch 82 is a double-width, ten-position digital thumbwheel switch. Different operation modes, such as RUN, TEST, FEED LENGTH CALIBRATE, and FEED-AFTER-SENSE may be selected.

Feed length switch 84 is a three-digit, ten-position digital thumbwheel switch. The feed length can be selected in 0.012 inch nominal increments from 0 to 999 steps.

Cut/No Cut switch 86 is a two-position toggle switch which controls the operation of the knife assembly.

Start/Stop Switch 88 is a two-position toggle switch which controls the operation of the automatic paper cutter. When Mode switch 82 is in the RUN mode, the Start position of Start/Stop switch 88 initiates a paper cutter cycle, and the Stop position stops the paper cutter at the end of the present cycle.

Trim switch 90 is a push-button switch. It actuates the knife assembly for one cycle.

The remaining seven switches of the automatic paper cutter are located on auxiliary panel 74, which is located below main control panel 72 and is accessible through a hinged cover, the seven switches are Length of Cutout switch 92, Maximum Number of Prints switch 94, Feed-After-Cut Mark switch 96, Cut Mark-/No Cut Mark switch 98, Front/Rear Cut Sensor switch 100, Front Sensor Select switch 102, and Rear Sensor Select switch 104. In addition, light emitting diodes F HI and F LO are used to indicate sensor signal strength from the various segments of front indicia sensor assembly 52, and light emitting diodes B HI and B LO indicate the sensor signal strength of the various segments of rear sensor 54.

Length of Cutout switch 92 is a two-digit, ten-position digital thumbwheel switch. The length of cut can be selected in 0.012 inch nominal increments from 0 to 99 steps. Switch 92 is used primarily for straight borderless prints to control the length of slug cut out between the prints.

Maximum Number of Prints switch 94 is a two-digit, ten-position digital thumbwheel switch. The number set into switch 94 establishes the number of prints that will be cut before the paper cutter stops.

Feed-After-Cut Mark switch 96 is a three-digit, ten-position digital thumbwheel switch. Since sensors 52 and 54 are at a fixed distance from the knife assembly, the length of paper advance after a cut mark has been sensed must be varied depending upon the location of cut marks on the prints. The length of advance after a cut mark is sensed can be selected in 0.012 inch nominal increments from 0 to 999 steps using feed-after-cut mark switch 96.

Cut Mark/No Cut Mark switch 98 is a two-position toggle switch. The operator selects the proper mode depending upon whether the paper has or does not have cut marks.

Front/Rear Cut Sensor switch 100 is a two-position toggle switch. It selects which sensor (52 or 54) will be used for sensing the cut marks on the prints. The other sensor is automatically used to sense the end-of-order marks.

Front Sensor Select switch 102 is a one-digit, four-position digital thumbwheel switch. This switch individually selects the segments of front sensor 52 so that the segment with the largest output signal is used. Light emitting diodes F HI and F LO monitor the output signal strength of the sensor segment which is selected by switch 102.

Rear Sensor Select switch 104 is a one-digit, four-position digital thumbwheel switch. The function of Rear Sensor Select switch 104 is the same as that of Front Sensor Select switch 102, except it selects a segment of rear sensor 54. Light emitting diodes B HI and B LO monitor the output signal strength from the selected segment of rear sensor 54.

FIG. 3 is an electrical block diagram of the automatic photographic paper cutter. As shown in FIG. 3, power supply 150 supplies power to the various circuits and motors contained in the paper cutter. Power supply 150 is controlled by Power switch 78.

Paper cutter control 154 controls the operation of the paper cutter. Paper cutter control 154 receives inputs from the various switches of main control panel 72 and auxiliary panel 74 through control panel logic circuit 156. In addition, signals from reject/remake sensor 158, front indicia sensor 52 and rear indicia sensor 54 are processed by sensor amplifier circuit 160 and supplied through auxiliary panel 74 and control panel logic 156 to paper cutter control 154. Paper cutter control 154 also may receive inputs from optional foot switch 162 and print packer 164. Foot switch 162 is connected in parallel with the start contacts of Start/Stop switch 88 of main control panel 72 and allows the operator to initiate a feed-and-cut cycle without the use of hands. Packer 164 may be a photographic print sorter and packer such as the PAKOMP II photopacker manufactured by Pako Corporation. If the paper cutter is to be used in conjunction with packer 164, interconnection is necessary in order to coordinate the operation of the two devices.

The outputs of paper cutter control 154 control the operation of stepper motor 40. Control of AC motor 34 is achieved by means of knife clutch 60, paper clutch/-brake driver assembly 166, paper brake 16, and paper clutch 36. Paper cutter control 154 also supplies signals to control panel logic 156 which controls display 76 on the main control panel 72, and supplies output signals to packer 164 if the paper cutter is being used in conjunction with packer 164.

Figure 4:
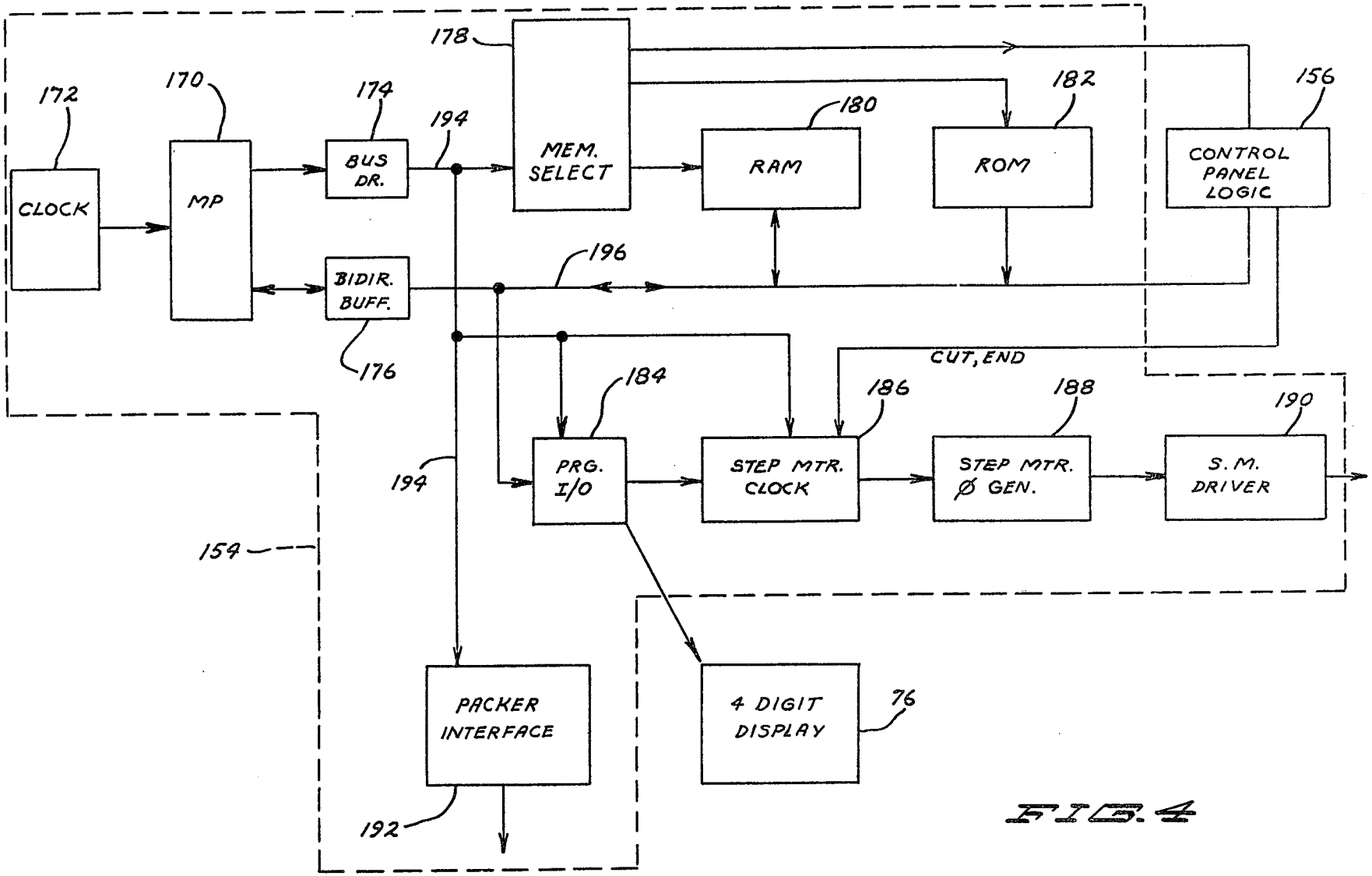
FIG. 4 is an electrical block diagram of the paper cutter control shown in FIG. 3.

FIG. 4 shows an electrical block diagram of paper cutter control 154. The paper cutter control includes microprocessor 170, clock 172, bus driver 174, bidirectional buffer 176, memory select circuit 178, random access memory (RAM) 180, read only memory (ROM) 182, programmable input/output (I/O) device 184, stepper motor clock 186, stepper motor phase generator 188, stepper motor driver 190, and packer interface circuit 192.

In one preferred embodiment, microprocessor 170 is an 8-bit microprocessor such as the Intel 8080A. Clock circuit 172 supplies clock signals, together with some other related signals, to microprocessor 170. Bus driver 174 receives outputs from microprocessor 170 and drives various lines of address bus 194. Memory select circuit 178 receives the signals from address bus 194 and addresses selected locations of RAM 180 or ROM 182. In addition, memory select circuit 178 may address the control panel logic 156 shown in FIG. 3 to interrogate the various switches of main and auxiliary control panels 72 and 74. In the system shown in FIG. 4, the switches of main and auxiliary panels 72 and 74 are addressed in the same manner as a memory location. Data to and from RAM 180 and data from ROM 182 and control panel logic 156 is supplied over data bus 196. Bidirectional buffer 176 interconnects microprocessor 170 with data bus 196.

Programmable I/O device 184 is also connected to data bus 196 and receives data from microprocessor 170. This data is used to control operation of stepper motor 40 through stepper motor clock 186, stepper motor phase generator 188, and stepper motor driver 190. In addition to the output signals from programmable I/O device 184, stepper motor clock receives the CUT and END signals from control panel logic 156.

Programmable I/O device 184 also controls the operation of display 76. Depending upon the particular mode selected by mode switch 82 on main control panel 72, display 76 may display the feed length, the feed-after-sense length, the number of prints in the previous order, the total number of prints since the cutter was turned on, or the total number of orders since the cutter was turned on.

As shown in FIG. 4, packer interface circuit 192 is also connected to address bus 194. Packer interface circuit 192 supplies the necessary signals to packer 164 of FIG. 3 to coordinate the operation of packer 164 with the operation of the automatic paper cutter.

The automatic paper cutter operation is commenced by turning on Power switch 78. Front paper guide 32 is then set to the appropriate paper width, paper roll 10 is installed on hub 12, and paper strip 18 is threaded through the paper supply and into the paper cutter.

The operator then selects the proper sensor assembly (either front sensor 52 or rear sensor 54) to sense cut marks by switching Front/Rear Cut Sensor switch 100 to the "Front" or the "Rear" position. The sensor assembly which is not selected is automatically used to sense end-of-order marks, which appear along the opposite edge of paper strip 18 from the cut marks.

The next step involves selecting a proper segment of the sensor assembly so that the largest sensor signal is provided. Mode switch 82 is placed in the SENSOR SELECT mode, and a portion of print paper strip 18 bearing a cut mark or end-of-order mark is oscillated back and forth past the sensor assembly. By changing the position of Front Sensor Select switch 102 (or Rear Sensor Select switch 104), the operator can individually select the segments of front sensor assembly 52 (or rear sensor assembly 54). Light emitting diodes F HI and F LO (or B HI and B LO) allow the operator to monitor the segment output signal strength for the segment then selected. Any signal which causes F LO ( or B LO) to light is an acceptable output signal strength. If the output signal also causes F HI (or B HI) to light, the output signal has a signal strength which is significantly higher than a mere acceptable signal. While more than one sensor segment may provide an acceptable output signal strength which lights F LO or B LO, generally only one sensor segment (the segment best postioned to sense the cut or end-of-order marks) will provide an output signal of sufficient strength to cause F HI or B HI to be lit. Based upon the outputs of the light emitting diodes, the operator sets the Front and Rear Sensor Select switches 102 and 104 to the settings which select the proper segments of sensor assemblies 52 and 54 so that the largest sensor signals are provided.

Mode switch 82 is then set to the FEED LENGTH CALIBRATE mode, Start switch 88 is actuated and one print is fed from cut mark to cut mark. The feed length is displayed on display 76 and that value is set into Feed Length switch 84 by the operator.

The operator then sets Mode switch 82 to the FEED-AFTER-SENSE mode. The edge of a print is aligned with a calibration mark on one of the paper guides 30 and 32. Start switch 88 is actuated and the paper advances to the next cut mark and stops. The feed-after-sense length is displayed on display 76, and the operator sets that value into Feed-After-Sense switch 96.

The operator then sets Mode switch 82 to the RUN mode and sets Speed switch 80 to the desired cycle rate. If bordered or round cornered borderless prints are being cut, the paper cutter is then ready to operate. If straight borderless prints are being cut, the length of cutout must be set in Length of Cutout switch 92.

Automatic operation of the paper cutter can then be commenced by actuating Start switch 88. At the end of a shift or the end of a day, summary modes are available in which the total prints cut and total orders cut during that shift or that day are displayed on display 76.

Multichannel Indicia Sensor

The multichannel indicia sensor of the present invention is used to great advantage in the automatic photographic paper cutter described above. The multichannel indicia sensor accommodates wide variations in indicia size, shape, and location on paper strip 18 without requiring adjustment of the sensor position by the operator.

Figure 5:
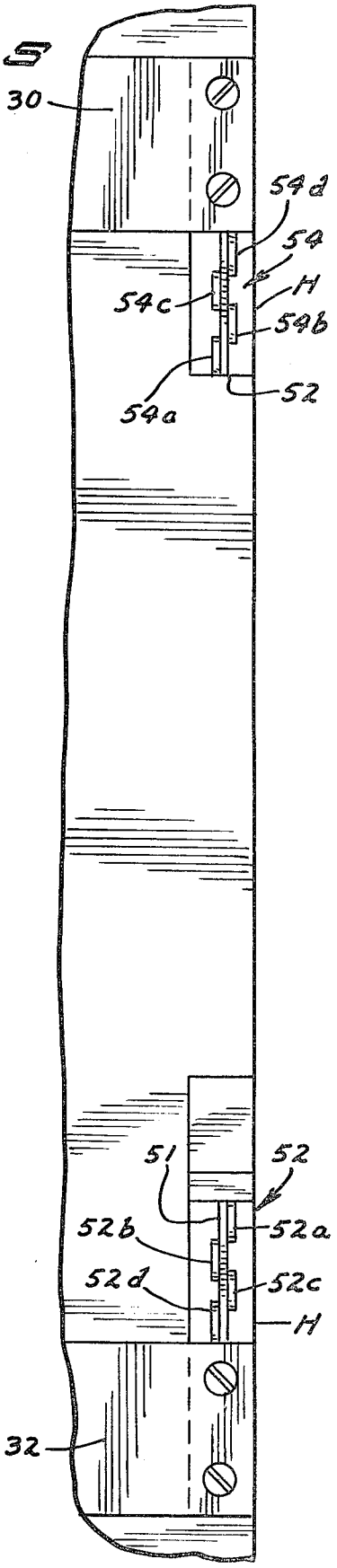
FIG. 5 is a detail view of the multichannel indicia sensor of the present invention.

FIG. 5 shows a detail view of the multichannel indicia sensors of the present invention. As shown in FIG. 5, the front indicia sensor assembly 52 is attached to front paper guide 32. As front paper guide 32 is moved to accomodate different widths of print paper, front indicia sensor assembly 52 moves with front paper guide 32. No other adjustment of the position of front indicia sensor assembly 52 in the direction perpendicular to the path of the paper (or for that matter in the direction parallel to the path of the paper) is required or permitted. This eliminates time consuming adjustments in sensor position by the operator and eliminates sensor error as a result of mispositioning by the operator.

Rear indicia sensor assembly 54 is not movable, since rear paper guide 30 is not movable. No operator adjustments of position of rear sensor assembly 54 is, therefore, required.

Front indicia sensor assembly 52 includes housing H, visible light source S1, and four sensor segments 52*a*–52*d*. In one preferred embodiment, sensor segments 52*a*–52*d* include four individual optical fibers which supply light to four individual visible light detectors. The optical fibers allow greater spacing to be provided between the individual detectors. Rear indicia sensor 54 has, in the preferred embodiments, an identical structure to that of front indicia sensor 52.

Each of the four sensor segments 52a–52d produces an output signal in response to light reflected by the back side of print paper 18. A cut mark or end-of-order mark which appears on the back side of print paper 18 will cause one or more of sensor segments 52a–52d to exhibit a change in its output signal.

In the preferred embodiments of the present invention, adjacent sensor segments have slightly overlapping fields of view. This ensures that no cut mark or end-of-order mark will pass undetected between adjacent sensor segments.

Front Sensor Select switch 102 on auxiliary panel 74 allows the operator to select the front sensor segment which provides the highest output signal in response to a cut or end-of-order mark. The operator is aided in selecting the proper segment by the F HI and F LO light emitting diodes, which indicate which sensor segment produces an acceptable output signal (i.e. an output signal which exceeds a first threshold) and which sensor segment (if any) provides an output signal which exceeds a second higher threshold. When the sensor segments have partially overlapping fields of view, it is possible that adjacent sensor segments may both provide acceptable output signals which will cause light emitting diode F LO to be lit. If one of the two segments is in better position to sense the cut mark, however, it will provide a larger output signal which may cause light emitting diode F HI to be lit. In general, only one sensor segment will have a sufficiently high output signal to cause F HI to be lit.

In one preferred embodiment, sensors 52a–52d are capable of sensing marks from 0.031 inches to 0.531 inches from the edge of paper strip 18. Because a multichannel sensor assembly in used, the sensitivity of the sensor assembly is essentially uniform over this field of view. The particular sensor segment which is best positioned to sense the marks is selected and subsequently used to sense the marks.

Figure 6:
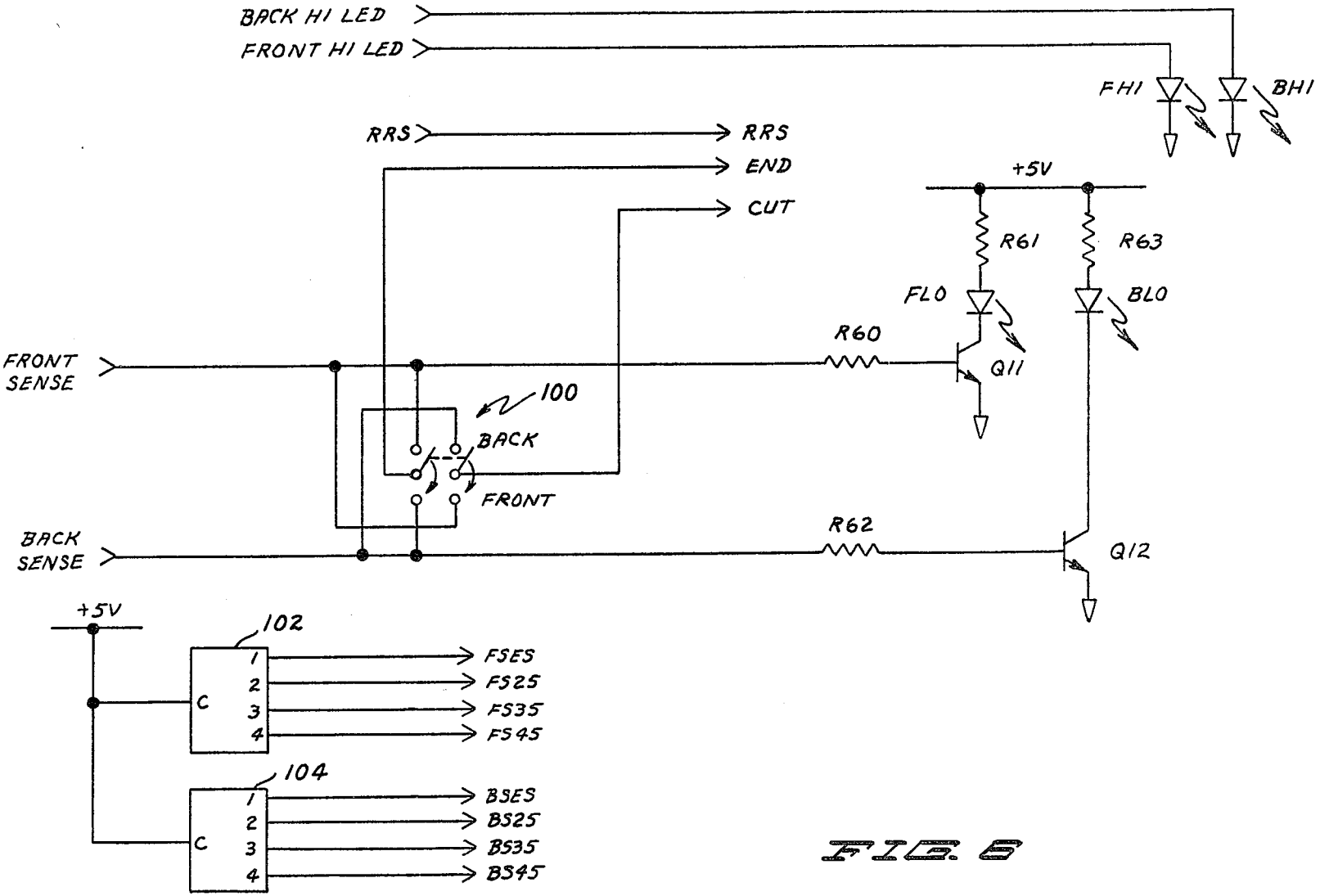
Figure 7:
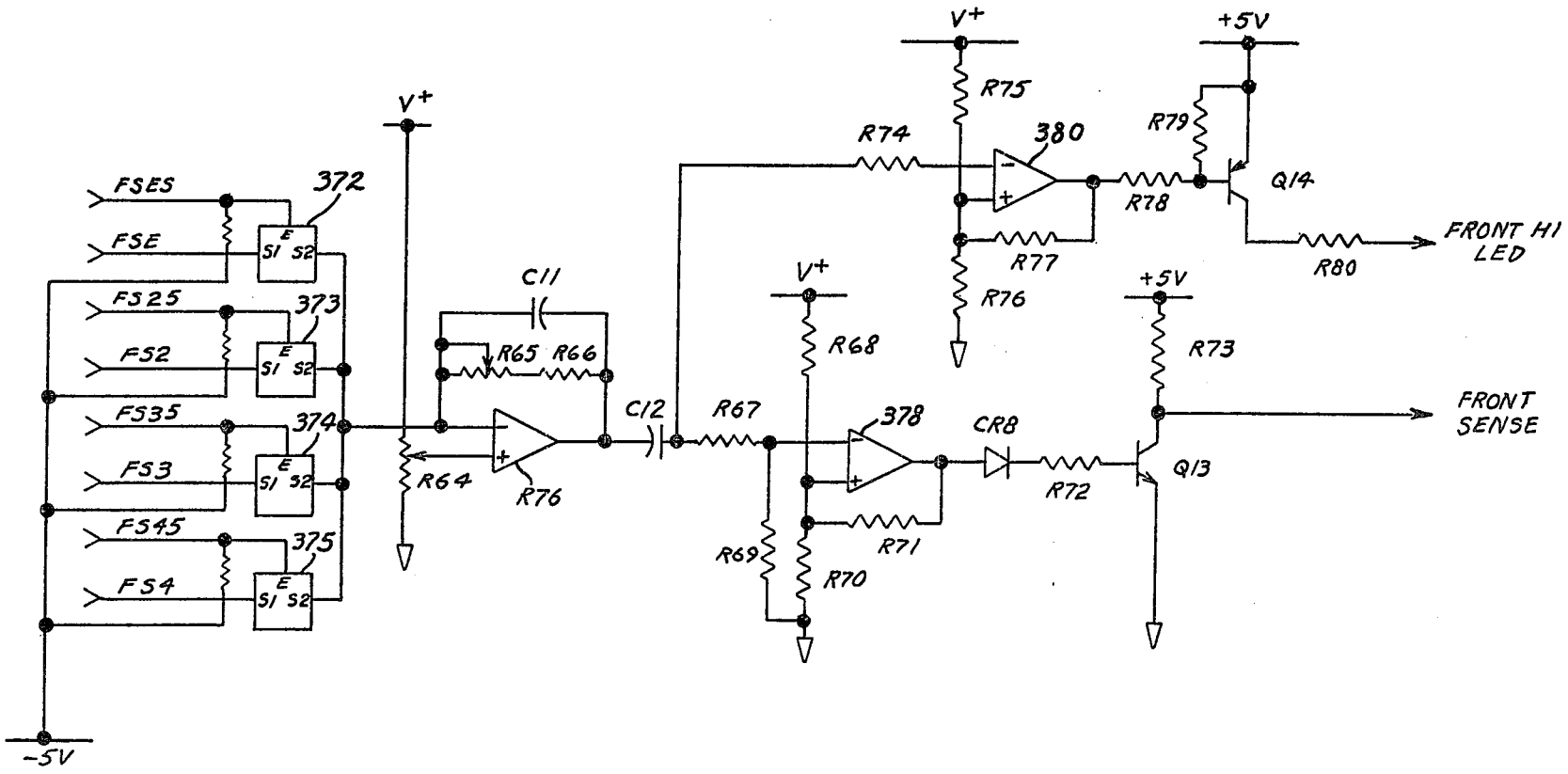

FIGS. 6 and 7 show the electrical circuitry of auxiliary panel 74 and sensor amplifier circuit 160 which receives the signals from front indicia sensor assembly 52 and produces the CUT or END signal which is supplied to paper cutter control 154. The circuitry shown in FIG. 6 is associated with auxiliary panel 74 and is used to select which sensor assembly (front or rear) will be used for sensing cut marks and which sensor segment should be used. The circuitry of FIG. 7 is the portion of sensor amplifier 160 which is associated with front sensor assembly 52. The circuitry associated with rear sensor assembly 54 is identical and, therefore, is not shown.

Front/Rear Cut Sensor switch 100 shown in FIG. 6 is a two-position toggle switch, which determines whether the front sensor assembly 52 or rear sensor assembly 54 will be used for sensing the cut marks. When Front/Rear Cut Sensor switch 100 is in the Rear position, as shown in FIG. 6, the BACK SENSE signal from sensor amplifier 160 is supplied to paper cutter control 154 as the CUT signal, and the FRONT SENSE signal is supplied to paper cutter control 154 as the END signal. If switch 100 is in the Front position, the FRONT SENSE signal is supplied as the CUT signal and the BACK SENSE signal is supplied as the END signal.

Auxiliary panel 72 includes four light emitting diodes F HI, F LO, B HI, and B LO. Light emitting diode F LO is connected in an annunciator circuit including resistors R60 and R61 and transistor Q11, and is lit each time the FRONT SENSE signal goes high. Similarly, light emitting diode B LO is in an annunciator circuit including resistors R62 and R63 and transistor Q12, and is lit each time the BACK SENSE signal goes high.

The other two light emitting diodes are used to assist the operator in selecting the segment of the front and rear sensors 52 and 54 which produce the highest output signals. The F HI and B HI light emitting diodes are energized by the FRONT HI LED and BACK HI LED signals, respectively, from sensor amplifier 160.

Front Sensor Select switch 102 is a one-digit, four-position digital thumbwheel switch. This switch individually selects the segment of front sensor assembly 52, so that the segment with the largest output signal can be used. Signals FSES, FS2S, FS3S, and FS4S from Front Select switch 102 are supplied to sensor amplifier 160. Only one of the four signals is high, depending upon the position of Front Sensor Select switch 102.

Rear Sensor Select switch 104 is a one-digit four-position digital thumbwheel switch. Its function is the same as Front Sensor Select switch 102, except that it selects segments of rear sensor assembly 54.

FIG. 7 shows the portion of sensor amplifier 160 which produces the FRONT SENSE and FRONT HI LED signals. The portion of the sensor amplifier 160 which produces the BACK SENSE and BACK HI LED signals is identical to the circuit producing the FRONT SENSE and FRONT HI LED signals and is not shown.

The FSES,. FS2S, FS3S, and FS4S signals from Front Sensor Select switch 102 are supplied to the E inputs of bidirectional switches 372–375, respectively. Switches 372–375 also receive the FSE, FS2, FS3, and FS4 signals from individual segments of front sensor assembly 52. Depending upon which sensor segment is selected, one of the sensor signals is supplied to a current amplifier circuit formed by comparator amplifier 376, resistors R64–R66, and capacitor C11. The output of the current amplifier circuit is AC coupled through capacitor C12 and supplied to two discriminator networks. The first discriminator network is formed by comparator 378 and resistors R67-R71. When the amplified sensor signal which is supplied to the inverting input of comparator 378 exceeds a first reference signal which is supplied to the non-inverting input of comparator 378, the output of comparator 378 goes low. This causes the buffer circuit formed by diode CR8, resistors R72 and R73, and transistor Q13 to produce a FRONT SENSE signal which goes high. The FRONT SENSE signal is only high when the amplified sensor signal exceeds the first reference signal.

The second discriminator network is formed by comparator 380 and resistors R74–R77. This second discriminator network works in essentially the same manner as the first discriminator network, except that the second reference signal which is supplied to the non-inverting input of comparator 380 is higher than the first reference signal. The output of comparator 380 of the second discriminator network only goes low when the amplified sensor signal exceeds the higher second reference signal.

When the output of comparator 380 goes low, the buffer circuit formed by transistor Q14 and resistors R78–R80 produce the FRONT HI LED signal. This two-threshold system, therefore, allows the operator to select the sensor producing a signal which not only is acceptable (as determined by the first discriminator network) but also exceeds a second higher threshold (as determined by the second discriminator network). The sensor segment in the best position to sense indicia on the paper, therefore, is identified and selected.

The selection of the proper sensor segment is performed prior to commencement of normal paper cutting operation of the paper cutter. Mode switch 82 is set to the SENSOR SELECT position and the operator uses Front Sensor Select switch 102 (or Rear Sensor Select switch 104) to individually monitor the output signals from each of the sensor segments. By viewing the F HI and F LO (or B HI and B LO) light emitting diodes, the operator can determine which sensor segment is in the best position to sense the indicia on the paper. The operator then sets Front Sensor Select switch 102 (or Rear Sensor Select switch 104) to the desired segment, and that segment has its output signal supplied to sensor amplifier circuit 160.

It is clear that the selection of the proper sensor segment is a far simpler and less operator dependent procedure than the accurate positioning procedures required for the prior art indicia sensors. Significant savings and time and improved machine operation, therefore, result from the multichannel indicia sensor of the present invention.

Conclusion

The multichannel indicia sensor of the present invention accommodates wide variations in indicia size, shape, and location on the paper without requiring adjustment of the position of the sensor assembly by the operator. Although the present invention has been described with reference to preferred embodiments, workers skilled in the art will recognize that changes may be made in form and detail without departing from the spirit and scope of the invention. For example, although the present invention has been described in the context of a high speed, microprocessor controlled, automatic paper cutter, it may also be used to great advantage in conjunction with other automatic photographic paper cutters.

What is claimed is:

1. In a photographic paper cutter for cutting photographic prints from a strip of photographic paper which bears indicia for indicating desired cut locations, an improved system for sensing the indicia and controlling the operation of the photographic paper cutter, the improved system comprising:

an array of indicia sensors, each positioned to sense indicia on a different portion of the photographic paper and to produce output signals in response to sensed indicia;

paper feed oscillating means for feeding photographic paper bearing indicia back and fourth past the array of indicia sensors;

select means for selecting one of the array of indicia sensors which provides an acceptable output signal when the photographic paper is fed back and forth past the plurality of indicia sensors; and control means for controlling operation of the photographic paper cutter in response to output signals from the indicia sensor selected by the select means.

2. The invention of claim 1 wherein the indicia sensors have partially overlapping fields of view.

3. The invention of claim 1 wherein the control means comprises:

sensor signal processing means for processing sensor output signals and supplying first signals; and paper cutter control means for controlling driving of the photographic paper as a function of the first signals.

4. The invention of claim 3 wherein the select means comprises sensor select switch means for selectively connecting one of the indicia sensors to the sensor signal processing means.

5. The invention of claim 4 wherein the sensor signal processing means comprises:

first threshold circuit means for providing the first signal if the sensor output signal attains a first threshold level;

second threshold circuit means for providing a second signal if the sensor output signal attains a second threshold level; and first and second annunciator means for indicating in response to the first and second signals, respectively.

6. The invention of claim 5 and further comprising:

amplifier means for amplifying the sensor output signal and supplying the amplified sensor output signal to the first and second threshold circuit means.

7. An improved indicia sensor assembly for use in a photographic paper cutter in which photographic prints are cut from a strip of photographic paper bearing indicia which indicate desired cut locations, the improved indicia sensor assembly comprising:

an array of indicia sensors positioned to sense indicia on different, adjacent portions of the strip, each indicia sensor producing output signals in response to sensed indicia; and select means for selecting the indicia sensor of the array best positioned to sense the indicia on the strip.

8. The invention of claim 7 and further comprising:

monitor means for monitoring the output signals of the indicia sensors.

9. The invention of claim 8 and further comprising:

amplifier means for amplifying the output signal from the indicia sensor selected by the select means;

first threshold circuit means for providing a first signal indicative of a sensed indicium if the amplified sensor output signal attains a first threshold level;

second threshold circuit means for providing a second signal if the amplified sensor output signal attains a second threshold level; and wherein the monitor means comprises first and second annunciator means for indicating in response to the first signal and the second signal, respectively.

10. The invention of claim 9 and further comprising:

paper feed oscillating means for feeding photographic paper bearing an indicium back and forth past the array to permit an operator to monitor the output signals of the indicia sensors to determine which indicia sensor is best positioned to sense the indicia on the strip.

11. The invention of claim 7 wherein the array of indicia sensors is an essentially linear array of indicia sensors.

12. The invention of claim 11 wherein the indicia sensors of the essentially linear array are positioned to view essentially parallel portions of the strip.

13. The invention of claim 7 wherein adjacent indicia sensors of the array have partially overlapping fields of view.

14. A method of cutting photographic paper bearing indicia for indicating desired cut locations, the method comprising:

providing an array of indicia sensors at a position along a path of the photographic paper, each indicia sensor positioned to sense indicia on a different portion of the photographic paper and produce output signals in response to sensed indicia;

monitoring output signals from the indicia sensors while paper bearing the indicia is moved past the array;

selecting an indicia sensor from the plurality which is best positioned to sense indicia on the photographic paper; and feeding and cutting the photographic paper as a function of the output signals from the indicia sensor selected.

15. A method of cutting photographic paper bearing indicia for indicating desired cut location, the method comprising;

providing a plurality of closely spaced indicia sensors at a position along a path of the photographic paper, each indicia sensor positioned to sense indicia on a different portion of the photographic paper and to produce output signals in response to sensed indicia;

feeding a portion of the photographic paper bearing an indicium past the plurality of indicia sensors;

selecting an indicia sensor from the plurality which provides an acceptable output during the feeding;

feeding and cutting the photographic paper; and controlling the feeding and cutting in response to output signals from the indicia sensor selected.

16. In a photographic paper cutter for cutting prints from a photographic paper strip bearing cut indicia proximate either a front or a rear edge of the strip and bearing end-of-order indicia proximate the opposite edge, an improved indicia sensor system comprising:

front and rear paper guide means for guiding the photographic paper strip;

a front array of indicia sensors positioned in a fixed relationship with the front paper guide means, the indicia sensors of the front array being positioned to sense indicia at a plurality of positions proximate the front edge of the paper strip and to produce sensor output signals in response to indicia sensed;

a rear array of indicia sensors positioned in fixed relationship with respect to the rear paper guide, the individual sensors of the rear array being positioned to sense indicia on different portions of the photographic paper strip proximate the rear edge of photographic paper strip and producing rear sensor output signals in response to indicia sensed;

front/rear cut sensor select means for selecting which array will provide cut signals and which array will provide end-of-order signals in response to indicia sensed;

front sensor select means for selecting an individual sensor of the front array for sensing indicia; and rear sensor select means for selecting an individual sensor of the rear array for sensing indicia.

17. The invention of claim 16 wherein the front paper guide is movable in a direction essentially perpendicular to the direction of paper strip travel to accommodate different sizes of paper, and wherein the front array is attached to and moves with the front paper guide.

18. The invention of claim 16 and further comprising:

sensor amplifier means for receiving sensor output signals from the selected sensors of the front and rear arrays and producing a front-sense signal when the front sensor output signal exceeds a predetermined threshold and produces a back-sense signal when the rear sensor output signal exceeds the predetermined threshold, and wherein the front/rear cut sensor select means comprises switching means which supplies the front-sense signal as a cut signal and the back-sense signal as an end-of-order signal when in the front position and supplies the back-sense signal as the cut signal and the front-sense signal as the end-of-order signal when in the rear position.

* * * * *